US006616298B1

(12) United States Patent
Bernhard

(10) Patent No.: US 6,616,298 B1
(45) Date of Patent: Sep. 9, 2003

(54) DUAL LAMP SOCKET ADAPTER

(76) Inventor: Robert F. Bernhard, 2937 W. Gilbert Ave., Peoria, IL (US) 61604-2137

( * ) Notice: Subject to any disclaimer, the term of this patent is extended or adjusted under 35 U.S.C. 154(b) by 0 days.

(21) Appl. No.: 10/013,722

(22) Filed: Dec. 13, 2001

(51) Int. Cl.[7] ..... H01R 33/00

(52) U.S. Cl. ..... 362/226; 362/414; 362/285; 362/351; 362/431

(58) Field of Search ..... 362/226, 414, 362/418, 351, 353, 319, 235, 284, 285, 431

(56) References Cited

U.S. PATENT DOCUMENTS 1,157,180 A * 10/1915 Rose ..... 362/450
2,632,843 A * 3/1953 Montgue ..... 362/232
4,009,384 A 2/1977 Holland
4,171,754 A 10/1979 Rosado
4,318,160 A 3/1982 Dooley et al.
5,404,286 A 4/1995 Boutges
5,964,524 A * 10/1999 Qian ..... 362/414
6,416,207 B1 * 7/2002 Chang ..... 362/419

* cited by examiner

*Primary Examiner*—Sandra O'Shea
*Assistant Examiner*—Ali Alavi
(74) *Attorney, Agent, or Firm*—Patent & Trademark Services; Joseph H. McGlynn

(57) ABSTRACT

A lamp conversion device with a dual lamp socket for providing a selective incandescent and fluorescent light from the same lamp. The lamp conversion unit has an screw-type adjustable pole to raise or lower the light source according to the user's need. The conversion unit houses the light bulbs in the inverted position to direct the light downward for efficient use of the light source. The pole has a three way switch and one on-off switch. The conversion unit for the lamp has an attachment for use with a lamp shade.

7 Claims, 1 Drawing Sheet

DUAL LAMP SOCKET ADAPTER

BACKGROUND OF THE INVENTION

This invention relates, in general, to a conversion unit for a lamp, and in particular, to a conversion unit which has both incandescent and fluorescent lights capable of operating independently or together.

Description of the Prior Art

In the prior art various types of jacks have been proposed. For example, U.S. Pat. No. 4,318,160 to Dooley, et al, discloses an adapter for connecting a fluorescent lamp to an incandescent fixture.

U.S. Pat. No. 5,404,286 to Boutges discloses threaded fittings to adapt a shade for a table lamp to fit a floor lamp.

U.S. Pat. No. 4,009,384 to Holland discloses an asbestos sheet attached to a lamp to produce a pleasing scent.

U.S. Pat. No. US 4,171,754 to Rosado discloses a lamp with a

SUMMARY OF THE INVENTION

The present invention is directed toward a dual lamp socket adapter or conversion unit in combination with a lamp. The dual lamp socket adapter has both an incandescent light bulb and a fluorescent light bulb which can be operated independently or together if the user so requires.

The dual lamp socket adapter or conversion unit has a "T" shaped case mounted on the top of an adjustable pole. The "T" shaped case is configured to receive both an incandescent light bulb and a fluorescent light bulb in a manner such that both light bulbs are in the inverted position. The "T" shape case is equipped with inverted light sockets which are spaced apart and located on each side of the adjustable pole.

The adjustable pole has an adjustment means located at the midpoint of said pole which allows the pole to be raised and lowered. The pole is also equipped with a screw-type base which enables it to be anchored in the socket means located on the top of the lamp.

The adjustable pole is also equipped with a three-way light switch which allows the user to select the use of the incandescent, the fluorescent or both of these light bulbs together.

An on-off switch is also on the pole and is used to control the electrical power supplied to the lamp.

The "T" shaped case has an attachment means located on the top portion of the case which enables a lamp shade to be attached to the case.

It is an object of the present invention to provide a new and improved means of converting an incandescent type lamp fixture to a light fixture that has both an incandescent and a fluorescent light bulb.

It is another object of the present invention to provide a means of adjusting the height of the lamp by adjusting the height of the pole.

It is another object of the present invention to provide the user with a lamp having inverted incandescent and fluorescent bulbs for more efficient use of lighting.

These and other objects and advantages of the present invention will be fully apparent from the following description when taken in connection with the annexed drawings.

DESCRIPTION OF THE PREFERRED EMBODIMENTS

Figure 1:
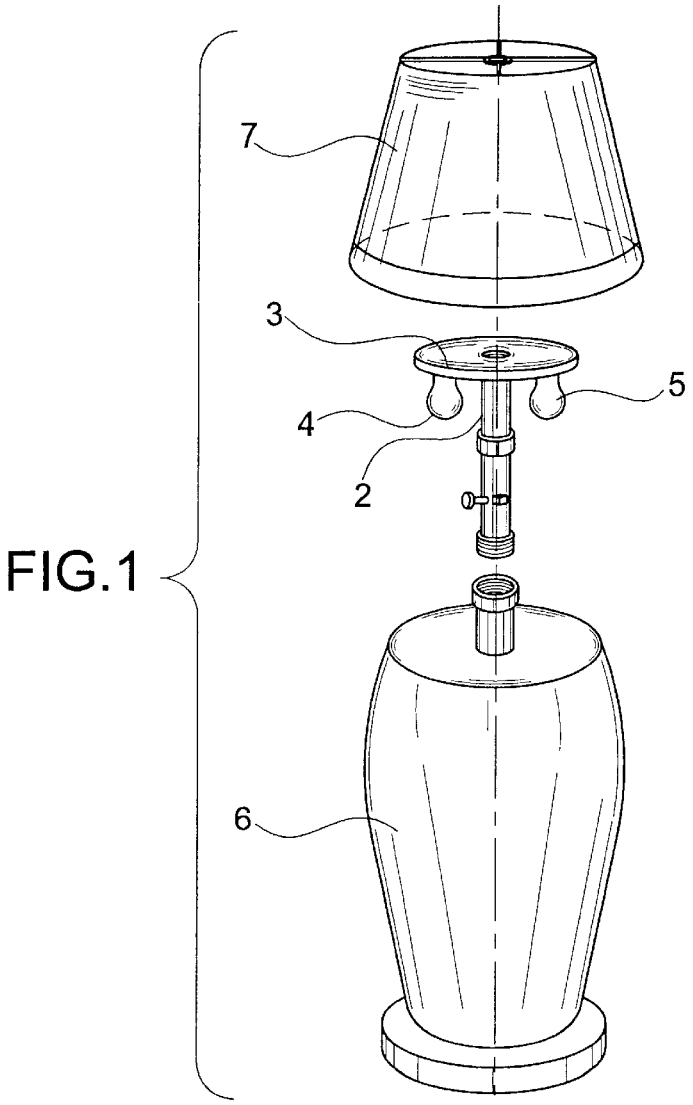
FIG. 1 is a perspective view the dual lamp socket adapter, lamp, and lamp shade.

Referring now to the drawings in greater detail, FIG. 1 shows the present invention 1 which includes a dual lamp socket adapter for bulbs 4, 5, lamp 6, and lamp shade 7. The present invention provides a light source from either an incandescent light bulb 4 or a fluorescent light bulb 5, or in the alternative both light bulbs 4 and 5 simultaneously.

The adjustable pole 2 is equipped with a "T" shape case 3, located on the top of the adjustable pole 2. The "T" shaped case is adapted to receive an incandescent light bulb 4 and a fluorescent light bulb 5. The light bulbs 4 and 5 are attached to case 3 in an inverted position to direct the light downward. The bulbs 4, 5 are electrically connected to the lamp by any conventional means. The adjustable pole 2 is attached to the lamp 6 and lamp shade 7 is attached to the top of the "T" shape case 3 by any conventional means.

Figure 2:
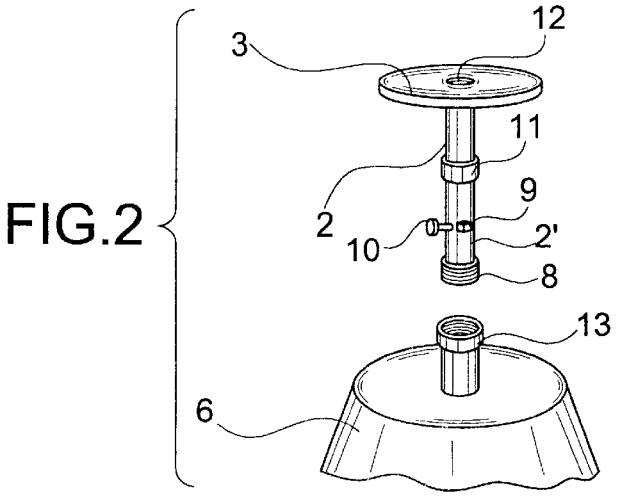
FIG. 2 is a perspective view of the dual lamp socket adapter in the extended position with screw type connecting means on the base of the adjustable pole and a lamp shade connecting means to attach the shade to the top portion of the "T" shaped case.

FIG. 2 shows the present invention with a threaded screw-type base 8 on the adjustment rod 2' which is adapted to be received by the socket means 13 located on the top of the lamp 6. The rods 2, 2' 13 are hollow to allow conventional electrical wires to be passed from the lamp 6 through the case 3 and then to the electrical sockets which receive the bulbs 4, 5. it should be noted since these wires are conventional they have not been shown in FIG. 2 for reasons of clarity.

An adjustment means 11 enables the adjustable pole to move up or down in order to place the bulbs either closer to, or further away from the lamp base 6 . The adjustment means comprises two telescoping poles 2, 2', 13, which can be adjusted higher or lower with respect to each other. Once the height is adjusted, the poles can be locked in position by means of the clamping ring 11. It should be noted that the adjusting means is a conventional means, therefore, no further description is necessary or will be given.

The three way light switch 10 allows the user to select the incandescent light 4, the fluorescent light 5 or both lights 4 and 5 together when the socket adapter is in use. The on-off switch 9 is used to turn the lamp on or off as desired by the user. The lamp shade 7 is held in place by the lamp shade attachment means 12, thus anchoring the shade on top of the "T" shaped case 3. The attachment means 12 is essentially an aperture with internal threads that will receive a screw, which is first passed through the lamp shade 7, and then threaded into the attachment means 12 in order to secure the shade 7 to the lamp base 6.

What I claim is:

1. An adapter for a lamp for converting an incandescent lamp to lamp having both incandescent and fluorescent bulbs, said adapter comprising:

a base, said base having a top and a bottom, said base top having means for receiving a supporting means for supporting at least a pair of light bulbs, said supporting means having adjustment means for adjusting a height of said supporting means, and said supporting means having a pair of light bulb sockets, one of said light bulb sockets receiving an incandescent bulb, and another of said pair of light bulb sockets receiving a fluorescent bulb, and means for selectively providing electricity to either said incandescent bulb or said fluorescent bulb.

2. the adapter as claimed in claim 1 wherein said supporting means comprise at least two telescoping tubes.

3. the adapter as claimed in claim 1 wherein said light bulb sockets are mounted on a horizontal cross piece.

4. the adapter as claimed in claim 3 wherein said cross piece has a top and a bottom, and said light bulb sockets are mounted on said bottom of said cross piece.

5. the adapter as claimed in claim 3 wherein said cross piece has means for supporting a lamp shade.

6. the adapter as claimed in claim 1 wherein said adapter also has switch means for turning both bulbs on and off.

7. An adapter for a lamp for converting an incandescent lamp to lamp having both incandescent and fluorescent bulbs, said adapter comprising:

a base, said base having a top and a bottom, said base top having means for receiving a supporting means for supporting at least a pair of light bulbs, said supporting means having adjustment means for adjusting a height of said supporting means, and said supporting means having a pair of light bulb sockets, one of said light bulb sockets receiving an incandescent bulb, and another of said pair of light bulb sockets receiving a fluorescent bulb, and means for selectively providing electricity to either said incandescent bulb or said fluorescent bulb, and wherein said light bulb sockets are mounted on a horizontal cross piece, and wherein said cross piece has a top and a bottom, and said light bulb sockets are mounted on said bottom of said cross piece, and wherein said cross piece has means for supporting a lamp shade, and wherein a lamp shade is attached to said means for supporting a lamp shade, and said light bulb sockets and said cross piece are contained within said shade.

* * * * *